US011325753B2

(12) United States Patent
Johnson

(10) Patent No.: US 11,325,753 B2
(45) Date of Patent: May 10, 2022

(54) THERMAL PIZZA SLICE CONTAINER APPARATUS

(71) Applicant: Shandelle Johnson, Brampton (CA)

(72) Inventor: Shandelle Johnson, Brampton (CA)

(73) Assignee: Shandelle Johnson, Brampton (CA)

( * ) Notice: Subject to any disclaimer, the term of this patent is extended or adjusted under 35 U.S.C. 154(b) by 468 days.

(21) Appl. No.: 16/540,213

(22) Filed: Aug. 14, 2019

(65) Prior Publication Data

US 2021/0047081 A1 Feb. 18, 2021

(51) Int. Cl.
*B65D 85/36* (2006.01)
*B65D 43/02* (2006.01)

(52) U.S. Cl.
CPC ..... *B65D 43/0204* (2013.01); *B65D 85/36* (2013.01); *B65D 2585/366* (2013.01)

(58) Field of Classification Search
CPC ..... B65D 43/0204; B65D 85/36; B65D 2585/366
USPC ..... 206/551
See application file for complete search history.

(56) References Cited

U.S. PATENT DOCUMENTS 1,470,763 A * 10/1923 Richards ..... A47J 47/14 206/551
3,620,403 A * 11/1971 Rump ..... B65D 43/0212 220/4.24
3,620,411 A * 11/1971 Rump ..... B65D 43/162 220/315
4,373,636 A 2/1983 Hoffman
4,811,846 A * 3/1989 Bottega ..... B65D 1/34 206/542
4,947,993 A * 8/1990 Bruml ..... A47G 19/26 206/551
4,981,234 A 1/1991 Slaughter
5,269,430 A * 12/1993 Schlaupitz ..... B65D 43/162 206/551
6,199,699 B1 3/2001 Eastman
6,601,403 B1 8/2003 Roth
D507,453 S 7/2005 Mills
7,427,001 B1 9/2008 Keitges
9,814,330 B2 11/2017 DiMeo
2007/0074532 A1 4/2007 Kagen
2009/0277914 A1 11/2009 Guyn
2010/0301056 A1* 12/2010 Wolfe ..... B65D 81/263 220/592.01
2014/0174039 A1* 6/2014 DiMeo ..... A47G 19/02 53/473
2017/0275077 A1* 9/2017 Chiang ..... B65D 85/70
2021/0002055 A1* 1/2021 Chiang ..... B65D 85/70

* cited by examiner

*Primary Examiner* — Jacob K Ackun

(57) ABSTRACT

A thermal pizza slice container apparatus for transporting a pizza slice and maintaining temperature includes a base having a base bottom side, a base sidewall, and an open base top side defining a base cavity. The base bottom side is sector-shaped and configured to accommodate a slice of pizza. A bottom lip is coupled to a perimeter of the open base top side. A lid has a lid top side, a lid sidewall, and an open lid bottom side defining a lid cavity. The lid top side is sector-shaped and conforms to the base bottom side. The lid sidewall has a flared lower portion that is selectively engageable with the bottom lip to seal and alternatively unseal the base cavity and the lid cavity. The base and the lid are each comprised of an outer shell layer and an inner insulation layer.

8 Claims, 3 Drawing Sheets

THERMAL PIZZA SLICE CONTAINER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to containers and more particularly pertains to a new container for transporting a pizza slice and maintaining temperature.

BRIEF SUMMARY OF THE INVENTION

An embodiment of the disclosure meets the needs presented above by generally comprising a base having a base bottom side, a base sidewall, and an open base top side defining a base cavity. The base bottom side is sector-shaped and configured to accommodate a slice of pizza. The base sidewall comprises a base crust portion and a pair of base side portions. The pair of base side portions meet at a base vertex. A bottom lip is coupled to a perimeter of the open base top side. A lid has a lid top side, a lid sidewall, and an open lid bottom side defining a lid cavity. The lid top side is sector-shaped and the lid sidewall comprises a lid crust portion and a pair of lid side portions. The pair of lid side portions meets at a lid vertex. The lid sidewall has a flared lower portion and a vertical upper portion. The flared lower portion is selectively engageable with the bottom lip to seal and alternatively unseal the base cavity and the lid cavity. The base and the lid are each comprised of an outer shell layer and an inner insulation layer continuously disposed on the outer shell layer.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
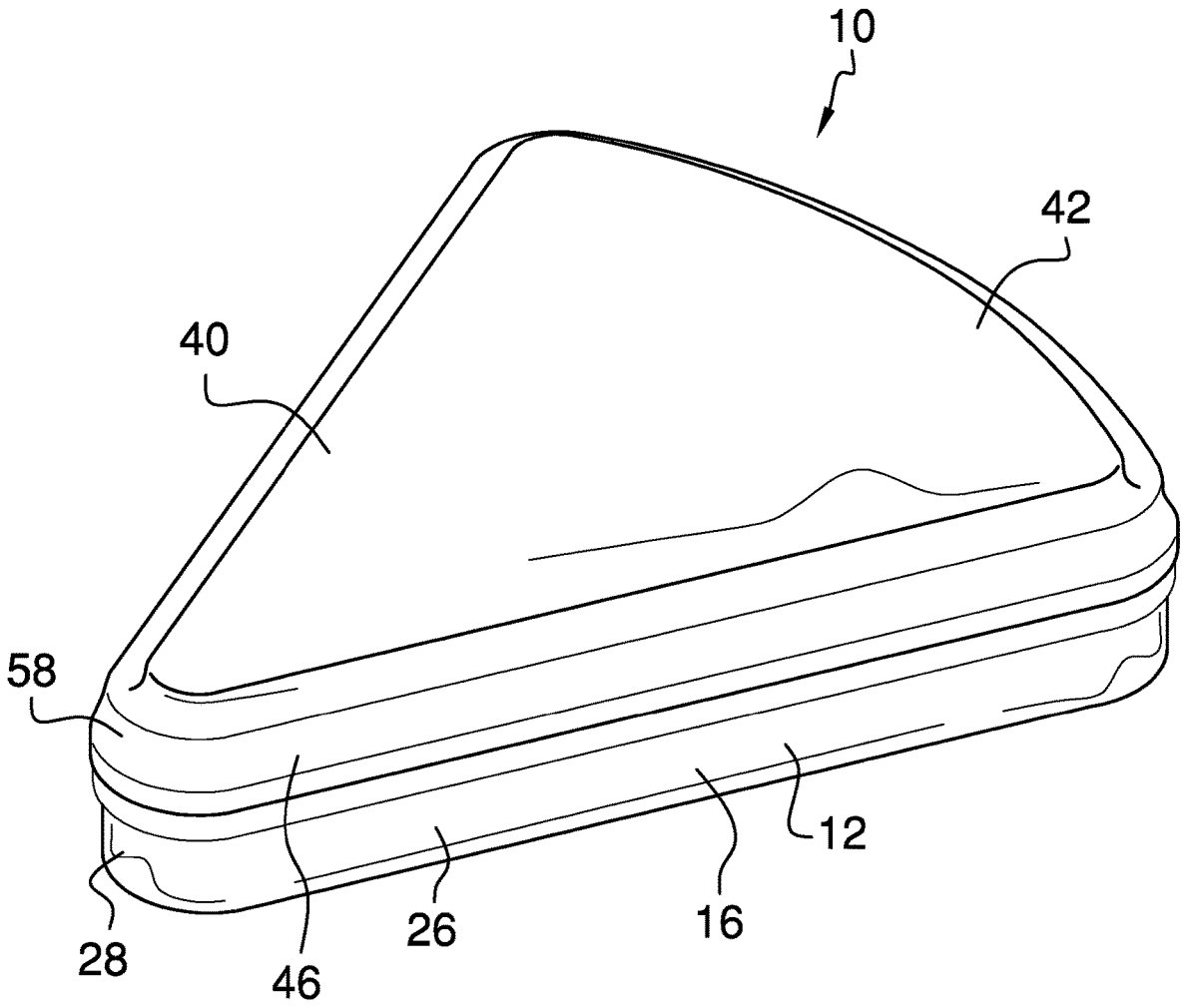
FIG. 1 is an isometric view of a thermal pizza slice container apparatus according to an embodiment of the disclosure.
Figure 2:
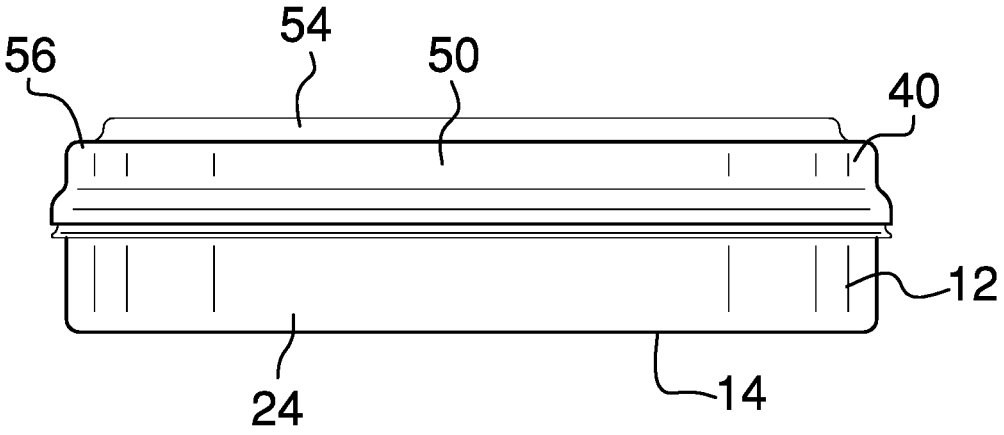
FIG. 2 is a rear elevation view of an embodiment of the disclosure.
Figure 3:
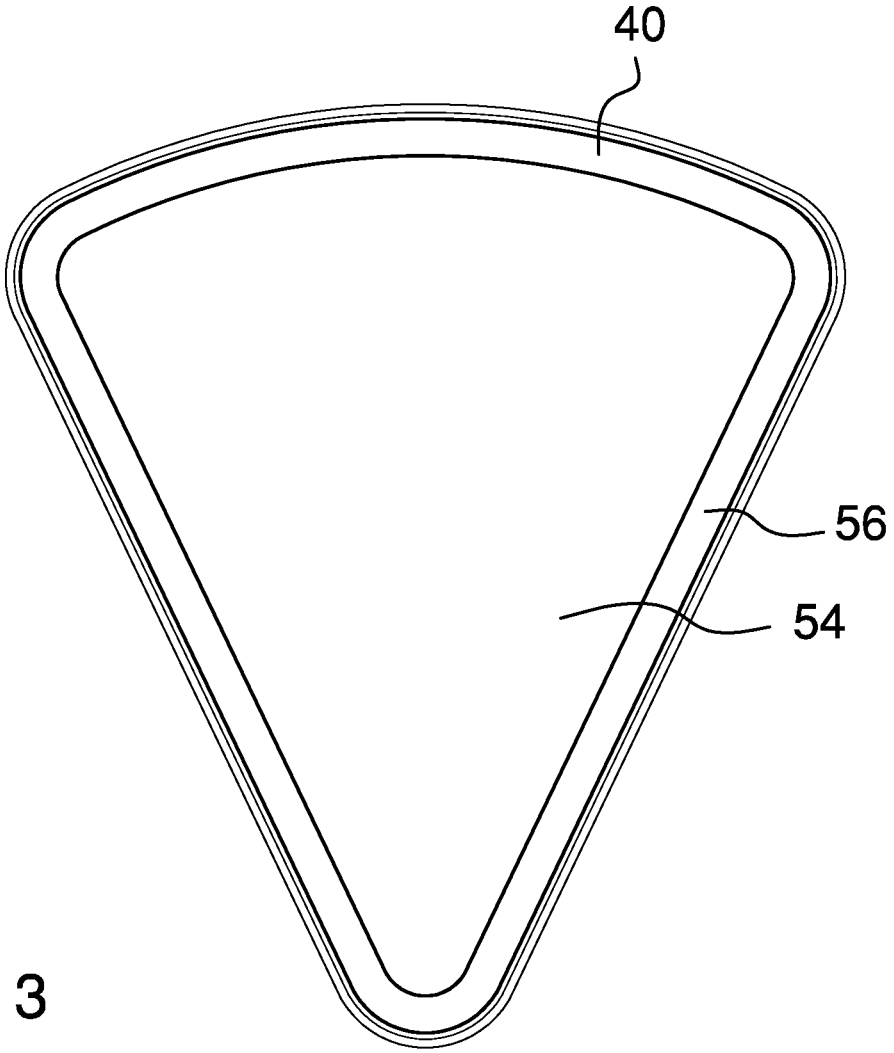
FIG. 3 is a top plan view of an embodiment of the disclosure.
Figure 4:
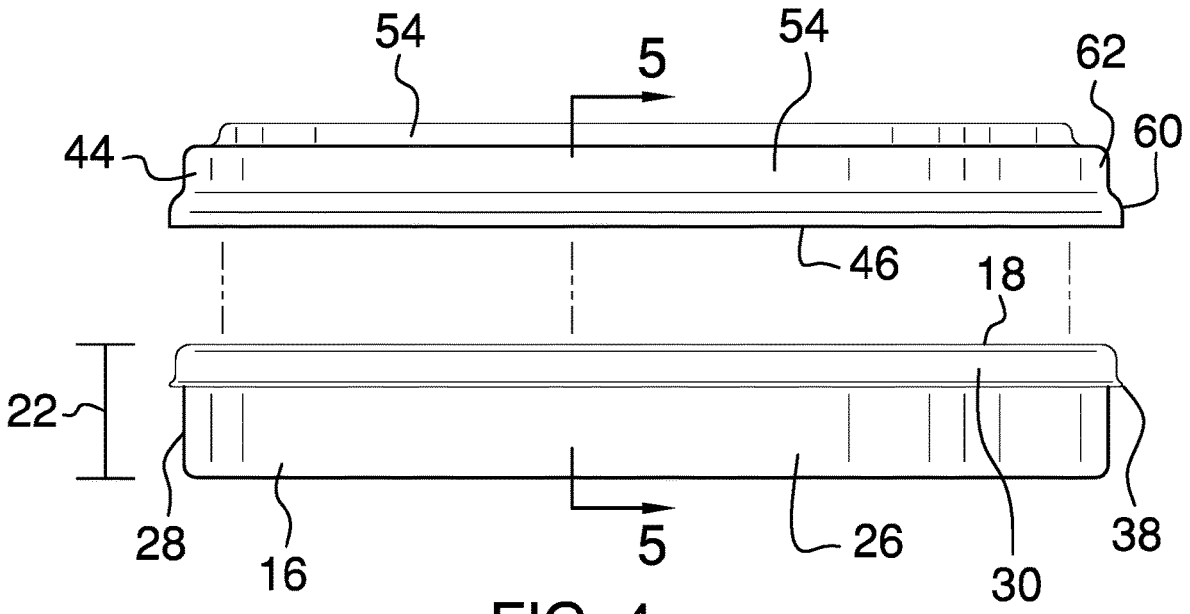
FIG. 4 is a side elevation view of an embodiment of the disclosure.
Figure 5:
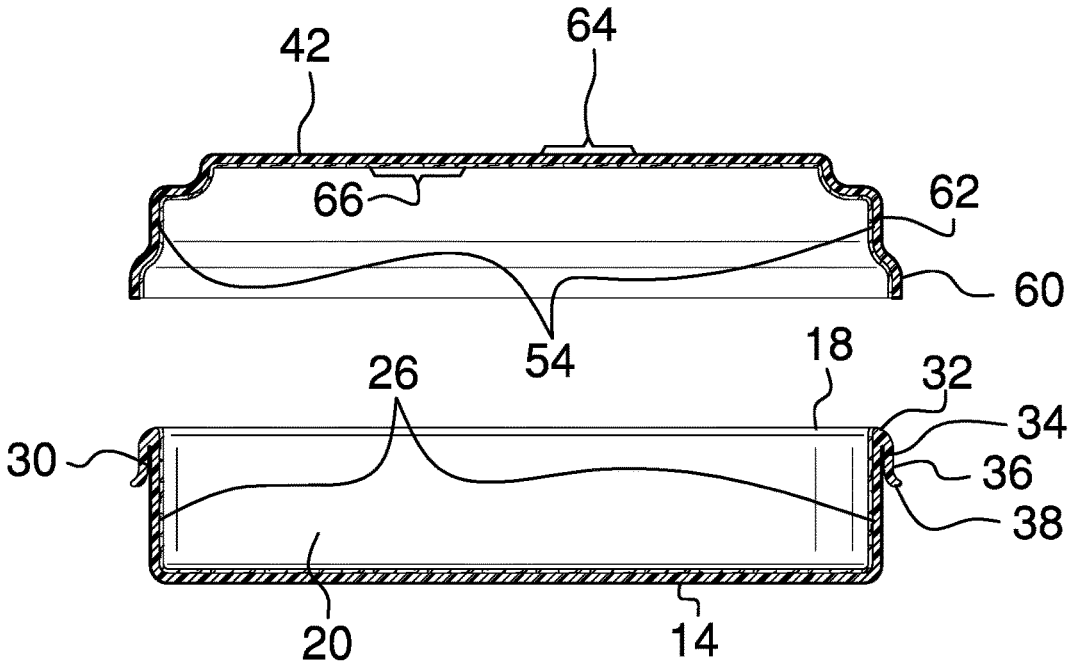
FIG. 5 is a cross-sectional view of an embodiment of the disclosure.

With reference now to the drawings, and in particular to FIGS. 1 through 5 thereof, a new container embodying the principles and concepts of an embodiment of the disclosure and generally designated by the reference numeral 10 will be described.

As best illustrated in FIGS. 1 through 5, the thermal pizza slice container apparatus 10 generally comprises a base 12 having a base bottom side 14, a base sidewall 16, and an open base top side 18 defining a base cavity 20. The base bottom side 14 is sector-shaped and is configured to accommodate a slice of pizza. The base sidewall 16 may have a height 22 configured to accommodate two pizza slices within the base cavity 20. The base sidewall 16 comprises a base crust portion 24 and a pair of base side portions 26. The pair of base side portions 26 meet at a base vertex 28. The base crust portion 24 has an arc length between 35° and 50° to accommodate a pizza slice from a pizza cut into eight or ten slices. The base 12 has rounded edges between the pair of base side portions 26 at the base vertex 28 and between the pair of base side portions 26 and the base crust portion 24. A bottom lip 30 is coupled to the base 12. The bottom lip 30 has an upper edge 32 coupled to a perimeter of the open base top side 18, a parallel portion 34 extending down parallel with the base sidewall 16, and a curled portion 36 extending away from the base sidewall 16 to a lower edge 38.

A lid 40 has a lid top side 42, a lid sidewall 44, and an open lid bottom side 46 defining a lid cavity 48. The lid top side 42 is sector-shaped and conforms to the base bottom side 14. The lid sidewall 44 comprises a lid crust portion 50 and a pair of lid side portions 52. The lid top side 42 may have a raised portion 54 and a perimeter portion 56 surrounding the raised portion 54. The raised portion 54 is proportionally sector-shaped with the lid top side 42. The lid top side 52 is filleted between the perimeter portion 56 and the raised portion 54. The pair of lid side portions 52 meet at a lid vertex 58. The lid crust portion 50 has an arc length between 35° and 50° conforming to the arc length of the base crust portion 24. The lid 40 has rounded edges between the pair of lid side portions 52 at the lid vertex 58 and between the pair of lid side portions 52 and the lid crust portion 50. The lid sidewall 44 has a flared lower portion 60 and a vertical upper portion 62. The flared lower portion 60 is selectively engageable with the bottom lip 30 to seal and alternatively unseal the base cavity 20 and the lid cavity 48. The bottom lip 30 may flex in order to create a snap seal with the lid 40. The base 12 and the lid 40 are each comprised of an outer shell layer 64 and an inner insulation layer 66 continuously disposed on the outer shell layer 64 in order to maintain the temperature of the pizza slice being stored or transported in the apparatus 10.

In use, pizza slices are placed within the base cavity 20 on the base bottom side 14. The lid 40 is then snapped onto the base 12 with the flared lower portion 60 engaging the bottom lip 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A thermal pizza slice container apparatus comprising:

a base, the base having a base bottom side, a base sidewall, and an open base top side defining a base cavity, the base bottom side being sector-shaped and configured to accommodate a slice of pizza, the base sidewall comprising a base crust portion and a pair of base side portions, the pair of base side portions meeting at a base vertex;

a bottom lip coupled to the base, the bottom lip being coupled to a perimeter of the open base top side; and a lid, the lid having a lid top side, a lid sidewall, and an open lid bottom side defining a lid cavity, the lid top side being sector-shaped, the lid sidewall comprising a lid crust portion and a pair of lid side portions, the pair of lid side portions meeting at a lid vertex, the lid sidewall having a flared lower portion and a vertical upper portion, the flared lower portion being selectively engageable with the bottom lip to seal and alternatively unseal the base cavity and the lid cavity;

wherein the base and the lid are each comprised of an outer shell layer and an inner insulation layer continuously disposed on the outer shell layer.

2. The thermal pizza slice container apparatus of claim 1 further comprising the bottom lip having an upper edge coupled to the base, a parallel portion extending down parallel with the base sidewall, and a curled portion extending away from the base sidewall to a lower edge.

3. The thermal pizza slice container apparatus of claim 1 further comprising the lid top side having a raised portion and a perimeter portion surrounding the raised portion, the raised portion being proportionally sector-shaped with the lid top side.

4. The thermal pizza slice container apparatus of claim 1 further comprising the lid top side being filleted between the perimeter portion and the raised portion.

5. The thermal pizza slice container apparatus of claim 1 further comprising the lid having rounded edges between the pair of lid side portions at the lid vertex and between the pair of lid side portions and the lid crust portion, the base having rounded edges between the pair of base side portions at the base vertex and between the pair of base side portions and the base crust portion.

6. The thermal pizza slice container apparatus of claim 1 further comprising the base sidewall having a height configured to accommodate two pizza slices within the base cavity.

7. The thermal pizza slice container apparatus of claim 1 further comprising the base crust portion and the lid crust portion having an arc length between 35° and 50°.

8. A thermal pizza slice container apparatus comprising:

a base, the base having a base bottom side, a base sidewall, and an open base top side defining a base cavity, the base bottom side being sector-shaped and configured to accommodate a slice of pizza, the base sidewall having a height configured to accommodate two pizza slices within the base cavity, the base sidewall comprising a base crust portion and a pair of base side portions, the pair of base side portions meeting at a base vertex, the base crust portion having an arc length between 35° and 50°, the base having rounded edges between the pair of base side portions at the base vertex and between the pair of base side portions and the base crust portion;

a bottom lip coupled to the base, the bottom lip having an upper edge coupled to a perimeter of the open base top side, a parallel portion extending down parallel with the base sidewall, and a curled portion extending away from the base sidewall to a lower edge; and a lid, the lid having a lid top side, a lid sidewall, and an open lid bottom side defining a lid cavity, the lid top side being sector-shaped, the lid sidewall comprising a lid crust portion and a pair of lid side portions, the lid top side having a raised portion and a perimeter portion surrounding the raised portion, the raised portion being proportionally sector-shaped with the lid top side, the lid top side being filleted between the perimeter portion and the raised portion, the pair of lid side portions meeting at a lid vertex, the lid crust portion having an arc length between 35° and 50° conforming to the arc length of the base crust portion, the lid having rounded edges between the pair of lid side portions at the lid vertex and between the pair of lid side portions and the lid crust portion, the lid sidewall having a flared lower portion and a vertical upper portion, the flared lower portion being selectively engageable with the bottom lip to seal and alternatively unseal the base cavity and the lid cavity;

wherein the base and the lid are each comprised of an outer shell layer and an inner insulation layer continuously disposed on the outer shell layer.

* * * * *